United States Patent [19]

Durgan

[11] 3,937,443

[45] Feb. 10, 1976

[54] CRANKCASE GUARD JACK UTILIZING DOUBLE PARALLELOGRAM

[75] Inventor: Virgil Richard Charles Durgan, Tremont, Ill.

[73] Assignee: Caterpillar Tractor Co., Peoria, Ill.

[22] Filed: July 11, 1975

[21] Appl. No.: 594,975

[52] U.S. Cl. ..... 254/10 B; 254/134

[51] Int. Cl.[2] ..... B66F 5/04

[58] Field of Search ..... 254/10 R, 10 B, 10 C, 133, 254/134; 214/1 D

[56] References Cited

UNITED STATES PATENTS

| | | | |
|---|---|---|---|
| 2,669,422 | 2/1954 | Branich | 254/134 |
| 2,749,089 | 6/1956 | Feay et al. | 254/134 |
| 2,994,443 | 8/1961 | Gordon | 254/10 R |
| 3,028,145 | 4/1962 | Brand | 254/134 |
| 3,850,419 | 11/1974 | Craig | 254/134 |

FOREIGN PATENTS OR APPLICATIONS

| | | | |
|---|---|---|---|
| 884,019 | 12/1961 | United Kingdom | 254/134 |

*Primary Examiner*—Al Lawrence Smith
*Assistant Examiner*—Robert C. Watson
*Attorney, Agent, or Firm*—Ralph E. Walters

[57] ABSTRACT

A jack or lift with a special fixture is provided for raising or lowering heavy and unusually shaped parts, such as crankcase and transmission guards for heavy-duty vehicles, such as track-type vehicles. The fixture on the jack engages the guard with a novel gripping or coupling arrangement for positively engaging the guard at two points. The gripping or coupling arrangement is vertically and horizontally adjustable to accommodate for different sized parts. A slope adjusting member is provided on the lift remote from the fixture to provide the third point of a three point support.

10 Claims, 4 Drawing Figures

CRANKCASE GUARD JACK UTILIZING DOUBLE PARALLELOGRAM

BACKGROUND OF THE INVENTION

1. Field of the Invention

This invention relates to lifting equipment and, more particularly, to a fixture for lifting equipment for use with heavy, unusually shaped parts.

2. Description of the Prior Art

In the heavy equipment field, such as track-type vehicles for earthmoving and the like, it is necessary to remove the crankcase guard or the transmission guard, or the like, to perform certain types of service on the vehicle. The guards and accumulated gravel and debris can weigh up to 4,000 pounds and are located beneath the vehicle in a relatively small work space which makes it difficult and dangerous to disconnect and remove same. Conventional floor jacks are either of insufficient capacity or are too unstable to handle the heavy, irregularly shaped guards or parts. Current linkage-type jacks are not able to adjust for a sloping part or to accommodate for the different load concentrations and, therefore, are subject to tipping or dumping the load.

Another prior art lift arrangement that has, of necessity, been used is a crane and cable sling. Unfortunately, cranes are not always available, cannot be tied up too long holding the part and are difficult and complicated to use even when available.

SUMMARY OF THE INVENTION

Hydraulically or electrically actuated lift or jack assemblies are commercially available and operate on a linkage principle such as to provide a large lifting capacity along a longitudinally oriented lift head supported on a stable platform. To the lift head of these assemblies is attached my novel fixture which includes a transverse box beam carried by one end portion of the lift head with outwardly adjustable members which support at the outer ends thereof vertically disposed coupling members. The lift head has a vertically adjustable slope accommodating member located at the end portion thereof remote from the box beam. The spaced coupling members and the remote vertically adjustable slope accommodating member form a three point support for a part to be supported on the lift assembly.

The spaced coupling members are horizontally and vertically adjustable so that a hook element and clamping bolt of each coupling member can be engaged with the part to hold and stabilize one end of the part. The slope adjusting member is moved into engagement with the other end of the part to support the part at a predetermined slope and orientation.

The part can now be disconnected, lowered and moved out of the way so repair or maintenance can be performed on the vehicle upon which the part had been installed. At the appropriate time, the lift assembly, with the part carried thereon, can be moved back into position so that upon actuating the lift, the lift head and fixture will raise the part and, with minor maneuvering, the part can be aligned with and reassembled to the member.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
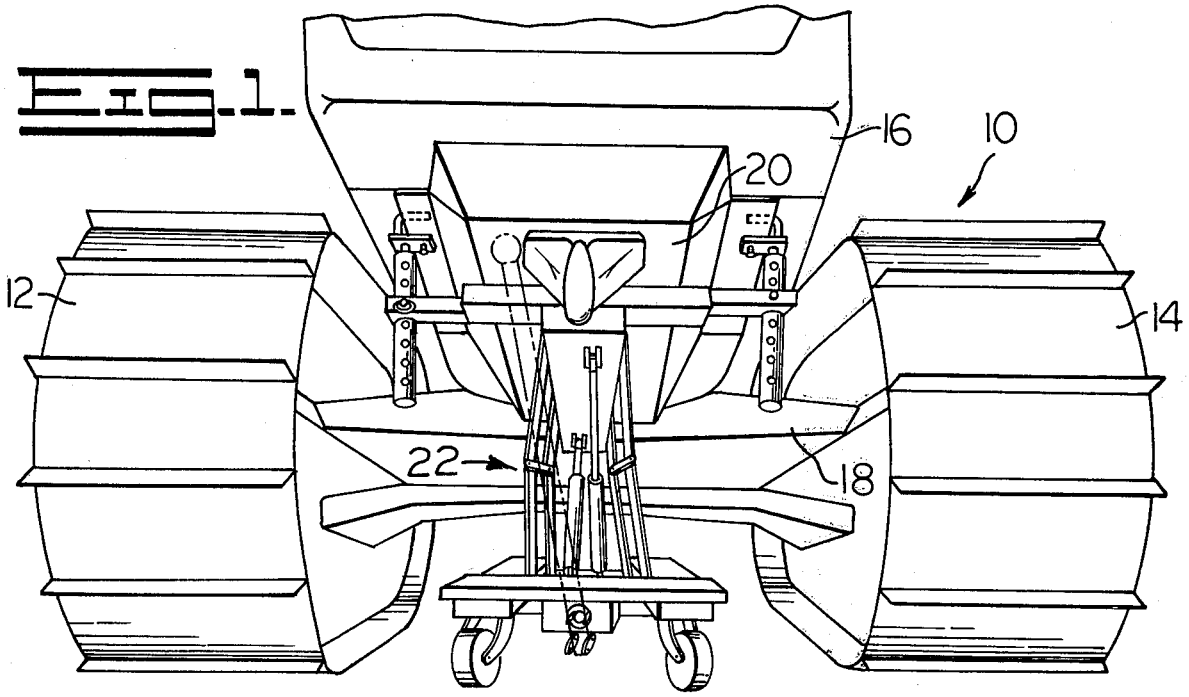
FIG. 1 is a front perspective view of a crawler tractor, shown somewhat in phantom, with the improved jack or lift assembly in one position beneath said tractor.

Referring to the drawings and, in particular, to FIGS. 1 and 2, a crawler tractor or track-type vehicle 10 is shown somewhat in phantom as viewed looking up from below with the track assemblies 12, 14 supporting a main frame 16 through a transversely extending front equalizer bar 18. Protecting the engine crankcase, the transmission, and the like, from damage during use are heavy-duty guards 20 which are bolted or otherwise secured to the main frame 16. In order to provide service to the crankcase, to the transmission, or the like, it is necessary to unbolt and remove the guards 20. After the service has been completed, the guards 20 must be replaced and rebolted in place. Each guard 20 and the accumulated gravel and other debris can weigh up to 4,000 pounds at the time of removal and, since the height of the space where the guard is located is low and the shape of the guard is irregular or unusual, it is almost impossible to use conventional jacks to remove and to lower the guard.

A low profile jack 22 is provided with an improved guard securing, quick attaching coupling means or fixture 24 and slope adjusting screw 26 for engaging the guard 20 as it is unbolted and lowered from the main frame 16. The low profile jack 22 is similar to a commercially available jack described in U.S. Pat. No. 3,598,366, dated Aug. 10, 1971 and assigned to the Milwaukee Hydraulic Products Corporation of Milwaukee, Wisconsin. The jack 22 is mounted on a base 28 which has a pair of parallel spaced apart U-shaped channels 30,32 which form the two sides of the base and which are held apart by the spaced cross bars 34,36. A box-shaped container 38 is attached to the front end portions of the U-shaped channels 30,32. A pair of large diameter, fixed rollers 40 are attached by means of brackets 42 to the rear lower end portions of the angle irons with a pair of rollers 44 attached by swivel brackets 46 to the front end portions of the channels 30,32. When desired, the front rollers 44 may be locked in place using any one of the well-known wheel locking arrangements.

Three vertically extending, equally spaced apart plates 48, 50, 52 are anchored to the cross bars 34,36 between the U-shaped channels 30,32. Pivoted between the plates 48 and 50 is the lower end of a cylinder 54 which has a piston (not shown) therein for driving a piston rod 56 outwardly from the end of the cylinder. A similar cylinder 58 is pivotally mounted between the plates 50 and 52 at a position spaced from the pivotal connection of the first cylinder 54, which cylinder 58, likewise, has a piston (not shown) connected to a piston rod 60 for driving said rod outwardly from the cylinder 58. A lift head 62 extends parallel to the plates 48,50,52 in the base 28 and has the end of the rod 56 of the cylinder 54 pivotally attached to the front end thereof with the end of the rod 60 of the other cylinder 58 pivotally connected thereto at a point spaced rearward thereof. A pump 64 is carried by the base 28 and has a handle 66 for use in moving the jack from place-to-place. The handle 66 is also connected to the pump, to serve as an actuator for the pump. The container 38 serves as a fluid reservoir for the hydraulic fluid for the pump 64. Pumping the handle 66 will actuate the pump 64, pumping fluid into the cylinders 54 and 58 for moving the piston rods 56,60 outward from the cylinders. A valve (not shown) on the pump 64 will serve, when actuated, to permit the fluid in the cylinders 54,58 to return to the box-shaped container or reservoir 38 thereby lowering the lift head 62 to a collapsed position on the base 28.

Pivotally connected to the plate 48 are the spaced apart ends of the parallel links 68 which have their other ends pivotally connected to a cross bar 70 and to the lower ends of a second pair of parallel links 72. The other ends of of links 72 are pivotally connected to the flange on the side of the lift head 62. Likewise, one end of the parallel links 74 are pivotally connected to the plate 52 with the other ends pivotally connected to the cross bar 76 and to the lower ends of the parallel links 78 which links in turn have the other ends pivotally connected to the opposite flange of the lift head 62. The lower sets of links form parallel linkages on each side of the pair of cylinders 54,58. Likewise, the upper links form parallel linkages which are connected to the lift head. With the valve on the pump 64 in the open position, the lift head 62 and the parallel linkage arrangements and cylinders, will all be collapsed and will form a low profile arrangement with respect to the base 28. Essentially, the structure just described with respect to the parallel linkages, the cylinders 54,58 and the ability of the lift head 62 to be collapsed into a low profile arrangement with respect to the base, is all as described in the above referred to U.S. Pat. 3,596,366. The orientation of the lift head 62 with respect to the base 28 in the present device provides for the lift head to be parallel to the lengthwise main channels 30,32 of the base 28 so that the lift head 62 extends longitudinally with respect to the base instead of at right angles thereto as provided for in the above referred to patent.

Figure 2:
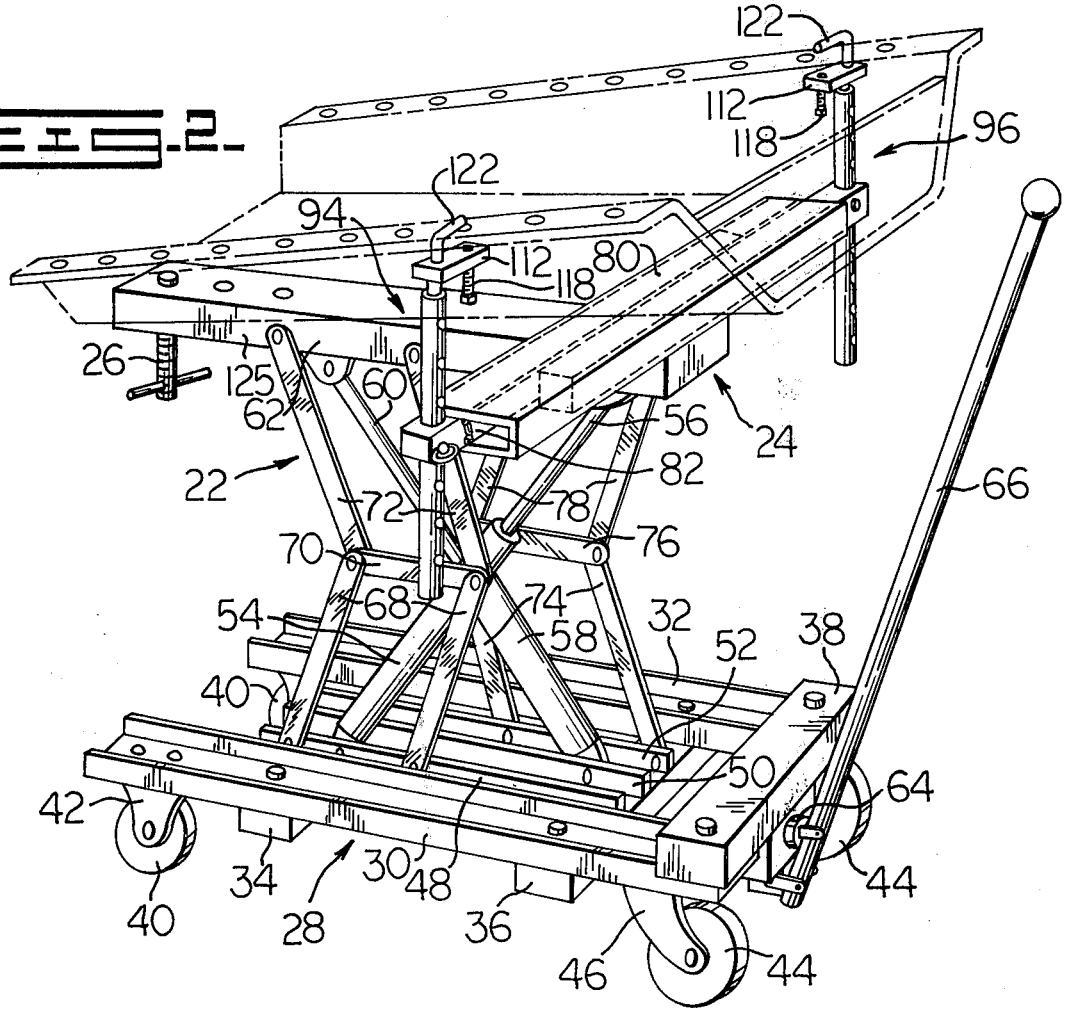
FIG. 2 is an isometric view showing structural details of the jack or lift assembly with the fixture and slope accommodating means thereon.
Figure 3:
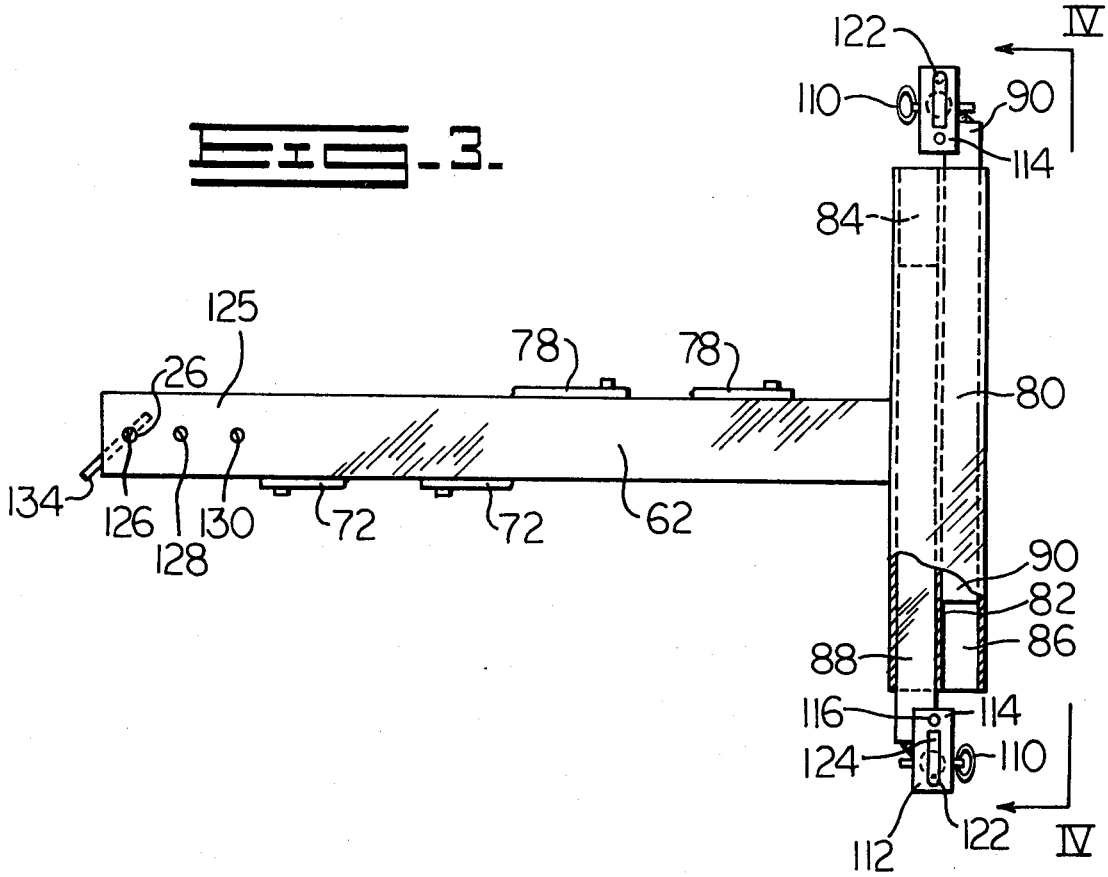
FIG. 3 is a top plan view of the lift fixture with parts broken away and in section; and, FIG. 4 is an end or front view of the lift fixture as viewed looking in the direction of the lines IV—IV of FIG. 3 with parts broken away or in section.
Figure 4:
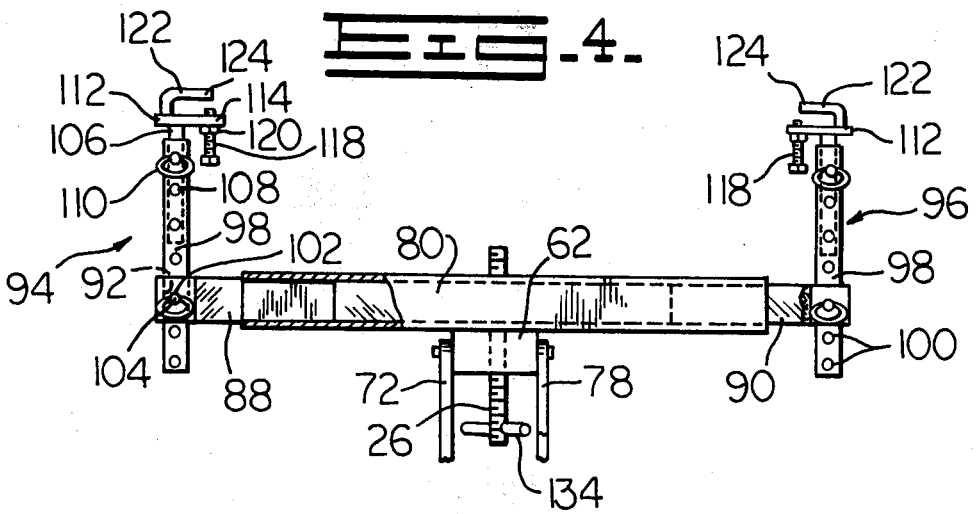

As best shown in FIGS. 2, 3 and 4, attached to the forward part of the lift head 62 is the improved, quick attaching coupling means or fixture 24 which comprises a box channel 80 welded or otherwise secured at its midportion to the forward end portion of said lift head 62 so that the axis of the box channel is at right angles to the axis of the lift head 62. A vertical partition 82 extends longitudinally of the box channel to divide the channel into two, substantially identical, rectangular-shaped chambers 84,86. A pair of oppositely extending support bars 88,90, each having a rectangular shape in cross section, are slidably disposed in the rectangular chambers 84,86, respectively, in the box channel. One support bar 88 extends out of the one end of the box channel 80 with the other support bar 90 extending out the other end of the support channel.

The outer end portion of each support bar 88,90 has a vertically disposed opening 92 therethrough in which is adjustably positioned a vertically extending telescopic coupling member 94,96, respectively. Each coupling member 94,96 has a tubular-shaped sleeve 98 which has a plurality of axially spaced apart openings 100 formed therethrough. An opening 102 is formed through the walls of the opening 92 in the ends of each support bar 88,90 so that a pin 104 can be inserted through the opening 102 in the bar 88 or 90 and through the aligned openings 100 in the sleeve 98 so as to hold the sleeve 98 in a fixed position with respect to the support bar. By removing the pin 104, the sleeve can be raised or lowered and the pin reinserted in the appropriate aligned openings. Slidably disposed in each tubular-shaped sleeve 98 is a telescopic rod 106 which has aligned openings 108 therethrough. A pin 110 is passed through the openings 100 in the tubular sleeve 98 and through the openings 108 in the rod 106 so as to position the end of the rod 106 with respect to the support bar.

Welded, or otherwise secured, to the top end of the rod 106 is a horizontally disposed rectangularly-shaped block member 112 which has one end portion 114 projecting in overhanging relationship with respect to the support bar 88 or 90. The end portion 114 of the block 112 has a threaded opening 116 through which is threaded a clamp bolt 118. The exposed end of the bolt 118 projects above the block. A lock nut 120 is provided on the bolt for locking the bolt in a fixed position with respect to the block 112. An L-shaped hook element 122 is secured to the block and has one leg 124 extending above and parallel to the block with the outer end portion in substantial alignment with the exposed end of the clamp bolt 118. Each support bar 88,90 has a vertically extending telescopic coupling member 94,96 with the hook element 122 and block 112 arrangement with the clamp bolt 118 threaded through the block so as to grip the edge of a guard 20 between the bolt 118 and the leg 124 of the hook element 122.

Since the support bars 88,90 are axially slidable relative to the box channel 80, any position of the coupling members 94,96 relative to each other can be easily obtained. The height of the coupling portions of the coupling members 94,96 with respect to the lift head 63 can be effected by removal of either or both of the pins 104,110 whereupon the sleeve 98 and/or the rod 106 of the coupling member can be extended or retracted prior to repinning at the desired height.

The opposite end portion or remote end portion 125 of the lift head 62 has several axially spaced apart threaded openings 126,128,130 extending therethrough. Although three openings are shown, it is contemplated that more or less openings can be provided depending on the type and style of loads to be worked upon with the lift. The threaded slope adjusting screw 26 is threaded through one of the openings 126,128,130 so that the projecting end of said screw 26 projects the desired distance above the plane of the lift head 62. A handle 134 is provided on the screw 26 to assist in turning the screw. A lock nut may be provided on the screw so as to lock the screw in any desired extended position. The adjusting screw 26 can be threaded through any one of the several openings in the lift head so as to provide the third point of a three point support for the guard, or the like, being lifted and supported by the jack or lift arrangement. The slope adjusting screw 26 is adapted to engage the remote end of the element being lifted, such as a guard 20, so that the guard is held on the jack at the same angle that it would normally have with respect to the main frame of the track-type vehicle. Maintaining the slope of the guard will assist in removing the guard from the frame and aligning the guard with the studs or bolt holes during reassembly.

In operation, the retaining bolts for the guard are loosened sufficiently to allow the hook elements 122 of the coupling members 94,96 to pass between the upper surface of the guard and the lower surface of the main frame of the vehicle. The jack is positioned below the guard and by actuating the pump, the jack is raised until the lift had 62 and box channel 80 are in general alignment with the guard. The coupling members 94,96 are adjusted axially outward with respect to the lift head 62 and are raised and pinned in the position with the hook elements 122 above the lip of the guard and with the blocks 112 and clamp bolts 118 below the lip of the guard. Each clamp bolt 118 can be threaded so as to grip the edge of the guard between the bolt 118 and the hook element 122. In some cases, the end of the threaded bolt may be extended into one of the bolt holes in the lip of the guard so as to further stabilize the guard relative to the lift. The slope adjusting screw 26 is placed in the proper opening 126,128 or 130 so as to align with the rear end portion of the guard whereupon the screw is turned until the end of the screw 26 contacts the bottom of the guard so as to provide the third point of a three point support for the guard. The guard is now positioned at an angle or level depending upon its normal position of assembly with the main frame. At this point, the remaining bolts can be removed from the guard and the main frame so as to release the guard completely from the main frame.

The valve on the pump 64 is then released so as to permit the jack or lift to lower the guard from the main frame. The jack and the guard can then be wheeled from beneath the vehicle while the appropriate service is performed on the vehicle. The guard can be cleaned and serviced in a conventional manner. At the appropriate time, the jack with the guard 20 mounted thereon is repositioned below the main frame and by actuating the pump such as by pumping the handle 66, the guard is raised into position relative to the main frame. By maneuvering the jack, the guard is aligned with the proper position relative to the main frame and then by inserting bolts through the openings in the lip of the guard, the guard is loosely reassembled on the main frame. With the guard supported by the bolts, but spaced from the frame at least the distance equal to the diameter of the hook element 122, the coupling members 94,96 are removed, the jack is lowered and then the appropriate arrangements are made to completely secure the guard 20 in position on the vehicle.

The horizontal and vertical adjustment of the coupling members 94,96 on the fixture on the lift head 62 makes it possible to adjust the clamping means thereon for ready attachment to the edges of the guards or other elements on the vehicle that are to be lowered or raised. By adjusting the slope adjusting screw 26 in the appropriate opening, the slope of the guard can be accommodated for so that in the raising and lowering of the guard, it is maintained in the proper orientation with respect to the main frame of the vehicle which assists in assembling and disassembling the guard from the vehicle.

I claim:

1. In a jack having a base, a lift head, a pair of parallelogram linkages pivotally mounted on said base and on said lift head, a pair of hydraulic actuators pivotally connected at one end to said base and at the other end to said lift head, said pivoted connections of said actuators to said base and to said lift head being at spaced apart locations, the axis of each ram lying parallel to the plane of the adjacent parallelogram linkage and crossing each other in spaced apart relationship, pump means for raising said lift head and valve means associated with said pump for lowering said lift head, in combination with a fixture having a box beam mounted at its midportion to one end portion of said lift head and extending perpendicular to the axis of said lift head, support bars projecting from the opposite ends of said box beam, vertically extending telescopic coupling members carried by the outer end portions of said support bars, means on each coupling member for gripping a work load, and a slope adjusting means on said lift head at the end of said head spaced from said fixture whereby said means for gripping the work load may be secured to the edges of the work load and the slope adjusting means is moved into contact with a remote point of said work load prior to lowering said work load.

2. In a jack as claimed in claim 1 wherein said means on each coupling member for gripping a work load comprises a block carried by said coupling member, a hook element carried by said block and having a portion lying parallel to and spaced from a portion of said block, and a clamp bolt threaded through said block and having an end extending toward the plane of said portion of the hook element and adapted to grip a work load therebetween.

3. In a jack as claimed in claim 1 wherein said slope adjusting means comprises a threaded member threaded through an opening in said lift head.

4. In a jack as claimed in claim 1 wherein said support bars are extendable and retractable relative to said box beam.

5. A jack having a base, means on said base for raising and lowering a lift head, a fixture having a box beam mounted at its midportion of said lift head and extending perpendicular to the axis of said lift head, oppositely extendable support bars projecting from the opposite ends of said box beam, vertical coupling members carried by the outer end portions of said support bars, clamp means carried by the upper end portions of said coupling members, and a slope adjusting means threaded through said lift head at the end of said lift head spaced from said fixture whereby said clamp means is secured to the edges of an element and the slope adjusting means is moved into contact with a remote point of said element prior to removing and lowering said element.

6. A jack as claimed in claim 5 wherein said clamp means includes a block carried by said coupling member, a hook element carried by said block and having a portion spaced from and overlying said block and a clamp bolt threaded through said block and generally aligned with said portion of the hook element.

7. A jack as claimed in claim 5 wherein said coupling members are vertically extendable for raising and lowering the clamp means carried thereby.

8. In a jack having a base, means on said base for raising and lowering a lift head, means for moving said jack from one location to another, a fixture mounted to one end portion of said lift head and extendable perpendicular to the axis of said lift head, support bars projecting from the opposite ends of said fixture, vertically extendable coupling members carried by the outer end portions of said support bars, a block carried by and extending at a right angle to the upper end of each coupling member, a hook element carried by said block and having a portion overlying said block, a clamp means threaded through each block and extending toward said overlying portion of the hook element, and a slop adjusting screw threaded through said lift head at the end of said head spaced from said fixture whereby said hook elements and clamp means are secured to the edges of an element and the slope adjusting means is moved into contact with a remote point of said element prior to removing and lowering said element.

9. In a jack as claimed in claim 8 wherein each said coupling member included a tubular member and a telescoping rod slidably received in said tubular member, means engaging the tubular member and the rod to lock the two relative to each other and means engaging between the support bar and the tubular member for locking the tubular member relative to the support bar.

10. In a jack having a base with casters connected to the bottom corners thereof, a pair of spaced apart channel-shaped tracks carried by said base and extending front to rear of said base, a pair of parallelogram linkages, a lift head, said linkages being pivotally connected to said base and to said lift head, a pair of hydraulic cylinder means, each cylinder means being pivotally connected at one end thereof to said base and at the other end thereof to said lift head, said pivoted connections to said base and to said lift head being at spaced apart locations, the axis of each cylinder lying parallel to the plane of the adjacent parallelogram linkage and crossing the axis of the other cylinder in spaced apart relationship, pump means for raising said lift head and valve means associated with said pump for lowering said lift head, in combination with a fixture having a channel means mounted at its midportion to one end portion of said lift head and extending perpendicular to the axis of said lift head, oppositely extendable support bars slidable in and projecting from the opposite ends of said channel means, vertically projecting coupling members carried by the outer end portions of said support bars, a hook element and a block carried by and extending at right angles to the upper end of each coupling member, a clamp bolt threaded through each block and extending toward said hook element, and a slope adjusting screw threaded through said lift head at the end of said head spaced from said fixture whereby said hook elements and clamp bolts may be secured to the forward edges of an element and the slope adjusting screw may be moved into contact with a remote point of said element to removing and lowering said element.

* * * * *

UNITED STATES PATENT OFFICE

CERTIFICATE OF CORRECTION

PATENT NO. : 3,937,443

DATED : February 10, 1976

INVENTOR(S) : Virgil Richard Charles Durgan

It is certified that error appears in the above-identified patent and that said Letters Patent are hereby corrected as shown below:

Column 3, line 41, change U.S. Pat. "3,596,366" to --3,598,366--.

Column 5, line 10, change "had" to --head--.

Column 6, line 39, after "midportion" insert --to one end portion--;

line 64, change "extendable" to --extending--.

Column 7, line 6, change "slop" to --slope--.

Column 8, line 25, after "element" (first occurrence) insert --prior--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*